US005235148A

United States Patent [19]

Yamaguchi et al.

[11] Patent Number: 5,235,148

[45] Date of Patent: Aug. 10, 1993

[54] HEATING APPARATUS

[75] Inventors: Kimiaki Yamaguchi, Nara; Isao Kasai, Nabari; Shinichi Sakai, Yamatokoriyama; Susumu Murakami, Nara; Mitsuo Akiyoshi, Nara; Akinori Otsuka, Nara; Masaaki Sano, Yamatokoriyama, all of Japan

[73] Assignee: Matsushita Electric Industrial Co., Ltd., Osaka, Japan

[21] Appl. No.: 509,749

[22] Filed: Apr. 17, 1990

[30] Foreign Application Priority Data

Apr. 19, 1989 [JP] Japan ..... 1-099407
May 9, 1989 [JP] Japan ..... 1-115330

[51] Int. Cl.[5] ..... H05B 6/64

[52] U.S. Cl. ..... 219/10.55 B; 219/10.55 E; 219/10.55 F; 219/10.55 M; 219/494; 99/331; 99/DIG. 14

[58] Field of Search ..... 219/10.55 B, 10.55 E, 219/10.55 R, 460, 400, 490, 494, 504, 10.55 F, 10.55 M; 99/325, DIG. 14, 331; 126/21 A, 21 R; 328/3

[56] References Cited

U.S. PATENT DOCUMENTS

| | | | |
|---|---|---|---|
| 3,839,616 | 10/1974 | Risman | 219/10.55 B |
| 4,461,941 | 7/1984 | Fukuda et al. | 219/10.55 B |
| 4,587,393 | 5/1986 | Ueda | 219/10.55 B |
| 4,768,885 | 9/1988 | Maiser | 374/1 |
| 4,841,111 | 6/1989 | Kokkeler et al. | 219/10.55 B |
| 4,918,276 | 4/1990 | Oh | 219/10.55 B |
| 5,015,812 | 5/1991 | Kasai et al. | 219/10.55 B |
| 5,051,701 | 9/1991 | Kashimoto et al. | 328/3 |

FOREIGN PATENT DOCUMENTS

| | | |
|---|---|---|
| 198430 | 10/1986 | European Pat. Off. . |
| 238022 | 9/1987 | European Pat. Off. . |
| 289000 | 11/1988 | European Pat. Off. . |
| A353691 | 2/1990 | European Pat. Off. . |
| 367186 | 5/1990 | European Pat. Off. . |

*Primary Examiner*—Bruce A. Reynolds
*Assistant Examiner*—Tu Hoang
*Attorney, Agent, or Firm*—Spencer, Frank & Schneider

[57] ABSTRACT

A heating apparatus such as a microwave oven in which thermal energy of high-temperature vapor generated by heating an object is detected by a pyroelectric element and a resulting detection signal is used to control (stop) a heat source such as a microwave source, etc. Among AC voltages generated by the pyroelectric element due to heat exchange of the pyroelectric element, a voltage of a polarity generated at the time of heat discharge (temperature decrease) of the pyroelectric element is selected through a circuit means. A voltage generated by heat exchange between air moving slowly in a heating chamber and the pyroelectric element caused by the rotation of a turntable or the like is eliminated by another circuit means. A control section controls the operation of the heat source by deciding an output signal of the pyroelectric element by comparing it with a detection level determined in accordance with a noise level for a predetermined length of time after the start of the heating operation. Erroneous detection is thus prevented which otherwise might be caused by a noise voltage generated in the pyroelectric element by the thermal energy of a hot air staying in the heating chamber after the energization of the heat source or second heat source.

12 Claims, 6 Drawing Sheets

HEATING APPARATUS

BACKGROUND OF THE INVENTION

1. Field of the Invention

The present invention relates to a heating apparatus comprising a detection system for detecting high temperature water vapor emanating from an object and controlling a heat source by using the detection signal.

2. Description of the Related Art

A heating apparatus having a system for detecting automatically a finished state of a heated object finds applications in various forms. A humidity sensor for detecting humidity changes is most widely used as a detector for the detection system of such an automatic heating apparatus. The humidity sensor is used to detect changes in electrical resistance of an element due to the water molecules adsorbed on the surface thereof. In order to prevent the deterioration in sensitivity due to the smear of the element surface and to maintain a stable performance over a long period, it is necessary to burn off the smear from the element surface or take any other complicated procedure at regular intervals of time.

As disclosed in U.S. patent application No. 429,286, on the other hand, the inventors are studying a system in which the water vapor or other vaporized substance of high humidity emanated from an object with the heating thereof is collected by way of a vent formed in the wall of a heating chamber and is applied against a pyroelectric element outside of the heating chamber to detect a finished state of heating through a voltage generated from the pyroelectric element. This system is based on a physical phenomenon of a detection mechanism exchanging heat between the pyroelectric element and the vapor, and therefore unlike in conventional humidity sensors, the sensitivity would not be substantially affected by the smear of the element surface, thereby leading to the advantage of constructing a detection system in a very simple manner in principle.

The disadvantage of a system which utilizes temperature changes of the pyroelectric element caused by the heat of vapor is that the pyroelectric element would be undesirably energized to generate a voltage not only by vapor generated from an object but also by a high-temperature air, that is, hot air applied suddenly thereto. In the case of a microwave oven comprising an electric or gas heater as a secondary heat source other than microwaves, a hot air of the secondary heat source remains in a great amount immediately after a heating operation. If an object is heated with the microwave oven under this condition, the pyroelectric element responsive to the residual hot air would generate a voltage regardless of the temperature of the food and thus fail to discriminate the voltage due to the vapor emanated by the heating of the food, thereby leading to an erroneous detection.

Also, this problem is liable to arise after a long heating operation with microwaves alone, as well as after heating with an auxiliary heater of a microwave oven, because of a similar phenomenon similar to the one mentioned above due to an increased temperature of the heating chamber or the like, thus making it difficult to detect a heated condition of the object food (a finished condition by heat) with high accuracy without error.

With the increase in the temperature of the pyroelectric element, the smaller temperature difference with the vapor generated from the food reduces the detection sensitivity. This variation of detection sensitivity according to operating conditions makes it difficult to secure stable detection accuracy.

SUMMARY OF THE INVENTION

In view of the foregoing background, an object of the present invention is to provide a heating system using a pyroelectric element which is capable of detecting a high vapor temperature accurately without erroneously detecting residual heat in the heating chamber in repeated continuous operations of the heating apparatus when the apparatus body is heated to some degree such as immediately after the completion of a heater operation regardless of a change in the sensitivity.

The essential parts of the present invention include a section associated with sensor signal processing means for processing a voltage generated by the pyroelectric element and a section associated with control means for controlling various operations of the apparatus in response to a signal voltage processed by the sensor signal processing means.

First, a part of the present invention relating to the sensor signal processing means will be explained. A first feature of this part of the present invention is that the sensor signal processing means is configured to select a voltage having polarity generated by the discharge of heat from a pyroelectric element (such as when temperature drops) among the voltages generated with the heat exchange of the pyroelectric element. The sensitivity to heat is thus reduced below that to vapor. A second feature lies in that, of all the voltages generated from the pyroelectric element, the comparatively low frequency components generated by the pyroelectric element as a result of heat exchange with the residual hot air in the heating chamber are eliminated to remove the factors of erroneous detection. This residual hot air is induced with the drive of a turntable or like means for assuring uniform microwave heating. The turntable operates slower than the heat exchange caused by fluctuations of vapor from the object to be heated.

By use of the aforementioned two means, voltages generated by the heat of the residual hot air or the like other than the vapor generated from the object of heating are greatly dampened and eliminated as compared with the signal voltage generated by the vapor from the object, thereby preventing erroneous detection.

Now, an explanation will be made of the control section for receiving a signal voltage from the sensor signal processing means to effect detection and control. The voltage output of the pyroelectric element immediately after starting the heating operation is measured for a first predetermined length of time, and a threshold value providing a detection level is set from a formula based on the measured signal level as a noise level. The control section thus has a function to decide a finished condition by detecting a voltage output higher than the threshold produced by the pyroelectric element in response to the vapor emanating from the object food.

As a result, erroneous detection, (premature de-energization) due to residual heat or dispersion due to sensor sensitivity dispersion can be minimized.

BRIEF DESCRIPTION OF THE DRAWINGS

FIGS. 3A and 3B are diagrams for explaining a pyroelectric element of the heating apparatus in detail, of which FIG. 3A is a plan view and FIG. 3B is a sectional view.

DESCRIPTION OF THE PREFERRED EMBODIMENTS

A microwave oven with a heater providing a heating apparatus according to an embodiment of the present invention will be explained below with reference to the accompanying drawings.

Figure 1:
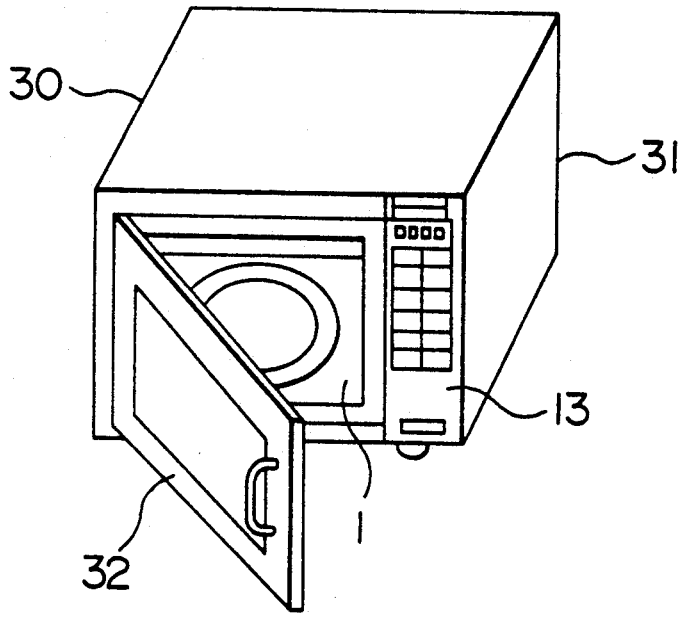
FIG. 1 is a perspective view of the external appearance of a heating apparatus according to an embodiment of the present invention.

As shown in FIG. 1, a microwave oven 30 comprises an operating section 13 for designating and applying an operation control command for the units on the front thereof, a body 31 on the outside thereof, and a freely openable door 32 in the opening of a heating chamber 1.

Figure 2:
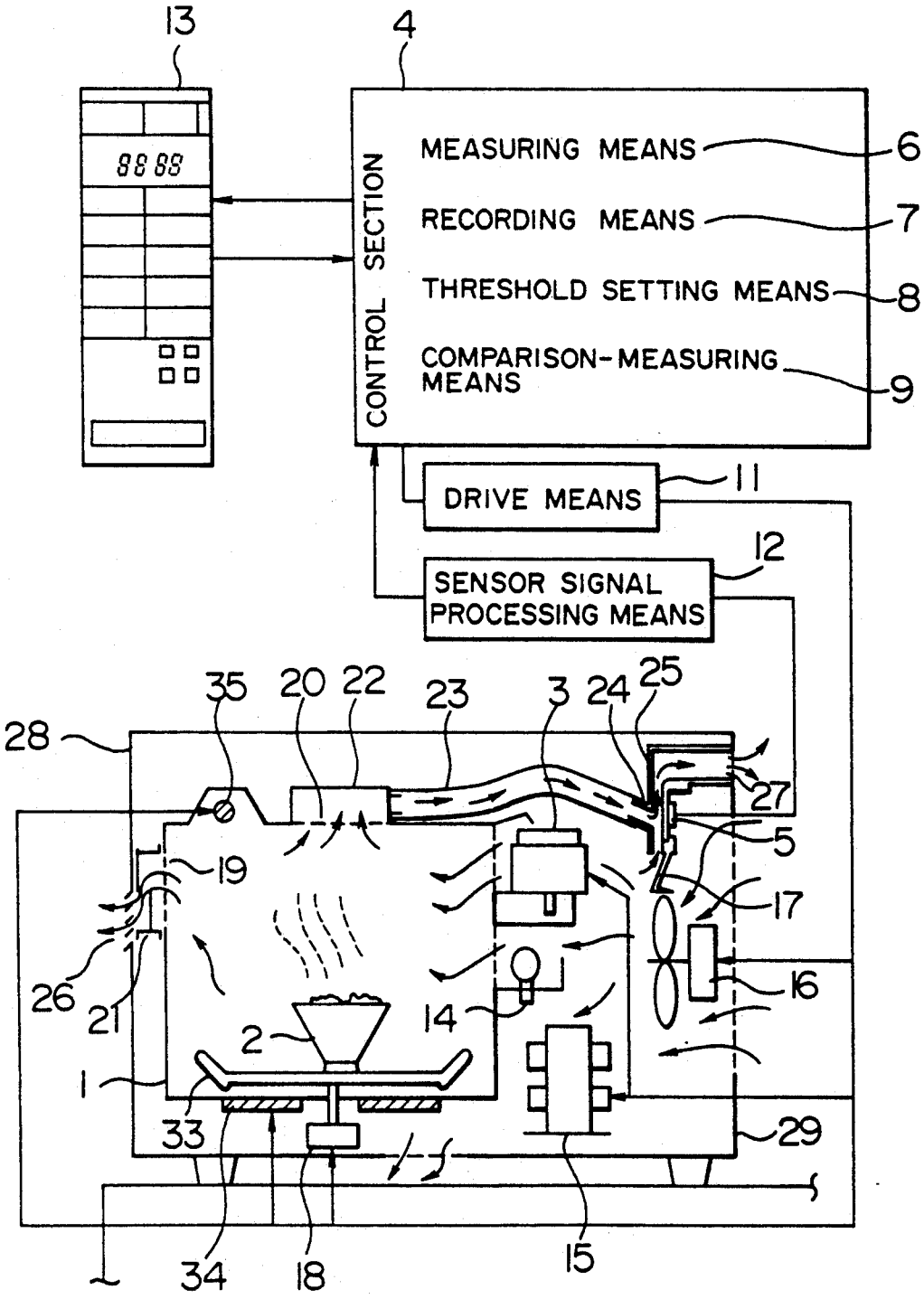
FIG. 2 is a diagram showing a system block configuration of the essential parts of the same heating apparatus.

It is seen from FIG. 2, on the other hand, that the heating chamber 1 has mounted on the walls thereof a magnetron 3 for supplying microwaves for heating an object 2 to be heated, an upper heater 35 and a lower heater 34 making up a second heat source for heating the object 2, and a lamp 14 for illuminating the interior of the heating chamber 1. A turntable 33 carrying the object 2 in the heating chamber 1 is driven (rotated) by a turntable motor 18 and rotates to assure uniform heating of the object 2 while being heated. A fan motor 16 produce sa wind for cooling a high-voltage transformer 15 for supplying a high voltage to the magnetron 3 and the lamp 14. The fan motor 16 also generates a wind (air flow) supplied into the heating chamber 1 for exhausting the water vapor and the like generated from the object 2 out of the heating chamber 1. The direction and amount of the wind generated is regulated by an orifice 17 formed beside the fan motor 16.

The high-voltage transformer 15, the fan motor 16 and the turntable motor 18 are controlled by drive means 11, the operation of which is in turn controlled by a control signal generated by control section 4.

The air sent from the fan motor 16, after entering the heating chamber 1, is exhausted (carried) out of the apparatus containing a water vapor gas of the object 2 by way of two exhaust paths. A first exhaust path or passage is formed from a route including a first exhaust port 19, a first exhaust guide 21 and a first vent 26 in that order. A second exhaust path is formed from a route including a second exhaust port 20, a second exhaust guide 22, a vent pipe 23, exhaust guides 24 and 25 and a second vent 27 in that order. The heat-sensitive surface of a pyroelectric element 5 having a pyroelectric characteristic is exposed from the interior wall surface of the second exhaust path.

Figure 3A:
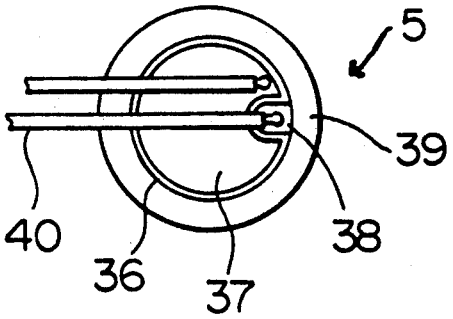
Figure 3B:
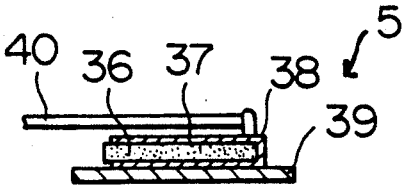

FIGS. 3A and 3B are diagrams for explaining the pyroelectric element 5 in detail. The pyroelectric element 5 includes a flat ceramic plate 36 having a pyroelectric effect, electrodes 37 and 38 formed on the sides of the ceramic plate 36, and a metal plate 39 made of stainless steel or the like bonded to the surface of one of the electrodes 37 and 38. This metal plate 39 functions as a heat-sensitive surface of the pyroelectric element 5. When a high-temperature gas like water vapor comes into contact with the metal plate 39, heat is transmitted to the ceramic plate 36 through the metal plate 39, and the ceramic plate 36 generates a voltage by the pyroelectric effect. In the case of the pyroelectric element 5 shown in FIG. 3B, the electrode 38 to which the metal plate 39 is bonded is partially extended to the opposite side of the ceramic plate 36 by way of a part of the periphery thereof, so that a lead wire 40 from the electrodes 37 and 38 may be taken out only by the side of the electrodes 37 and 38 to which the metal plate 39 is not bonded.

The ceramic plate 36 may be composed of PZT (lead zirconate-titanate ceramics), for example. The pyroelectric element 5 is polarized in such a manner that the electrode 37 has a positive polarity and the electrode 38 a negative polarity. Under this condition of polarization, a positive (plus) voltage is generated across an electrode 37 with the increase in temperature of the pyroelectric element 5.

As shown in FIG. 2, the object to be heated (food) 2 placed in the heating chamber 1 is heated dielectrically by microwaves (high-frequency waves) of 2450 MHz generated from the magnetron 3. The object 2 gradually increases in temperature, and when it reaches a temperature near the boiling point of water, emanates a great amount of high-temperature vapor. This vapor is passed through the second exhaust vent 20 formed in the ceiling of the heating chamber 1 and is applied against the pyroelectric element 5 through a cylindrical ventilation pipe 23. The vapor brought into contact with the pyroelectric element 5 supplies a great amount of thermal energy to the pyroelectric element 5. This thermal energy of course contains a great amount of latent heat generated by the vapor dewing on the surface of the pyroelectric element 5.

The sharp temperature increase of the pyroelectric element 5 disturbs the equilibrium of polarization in the pyroelectric element 5, and generates a pulse signal with sharp voltage changes in the electrodes on the surface of the element. A similar pulse signal, in opposite characteristics, also appears during a sharp temperature decrease such as when a heated pyroelectric element comes into contact with cold air.

The vapor generated from the object (food) 2 proceeds swayingly through air lower in temperature than the vapor, and therefore the amount of vapor coming into contact with the pyroelectric element 5 fluctuates with time and space. Even after the vapor is generated steadily, that is, when the temperature of the object 2 (food) is increased beyond a certain temperture, temperature changes (fluctuations), that is, heat exchanges at the pyroelectric element 5 occur repeatedly. Namely, the pyroelectric element 5 increases in temperature due to a great amount of vapor at one moment while the temperature thereof decreases with the vapor amount decreased at a next moment, followed by a temperature increase due to great amount of vapor generated.

As a result, the pyroelectric element 5 continues to generate an irregular pulse signal voltage (AC voltage) of positive and negative polarities in response to the heat exchanges (temperature fluctuations) described above, while the object (food) 2 continues to generate a high-temperature vapor.

In this way, as the temperature of the object 2 approaches the boiling point of water with the heating operation of the microwave oven, vapor is abruptly generated from the object 2, thereby causing a pulse voltage (AC voltage) V (several mV) of positive and negative polarities to be generated with in large amplitude corresponding to the fluctuations between the electrodes of the pyroelectric element 5. The voltage thus generated by the pyroelectric element 5 is transmitted through the sensor signal processing means 12 to the control section 4.

If the object 2 is in a reheating (food-reheating) menue, for instance, a substantially sufficient temperature is reached for the purpose of heating when a great amount of vapor begins to emanate. When the voltage generated by the pyroelectric element 5 reaches a predetermined detection level (threshold value), therefore, the control section 4 initiates the de-energization of the magnetron 3 and the cooling fan 16 as the basic principle of a detection system.

Figure 4:
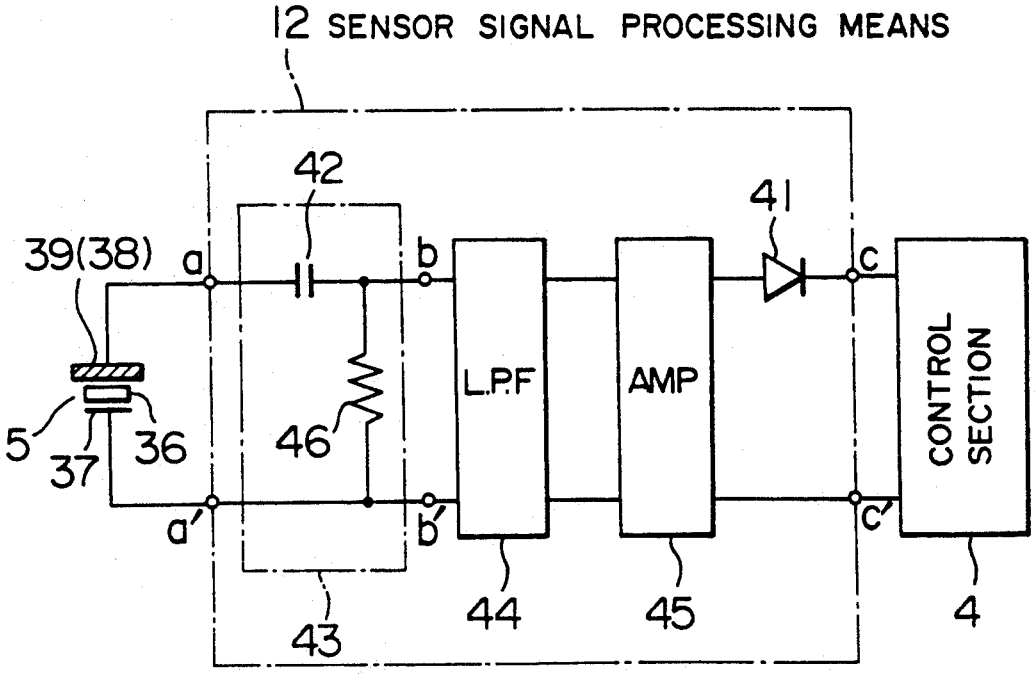
FIG. 4 shows a configuration of the essential parts arranged around sensor processing means and a pyroelectric element of the heating apparatus.

FIG. 4 is a diagram showing a circuit configuration of essential parts of a heating apparatus centered on the pyroelectric element 5 and the sensor signal processing means 12. Heating apparatus, that is, a microwave oven according to an embodiment of the present invention, and FIGS. 5A, 5B, 5C and 5D show voltage waveforms observed at specific points (a—a', b—b', c—c') in the circuit configuration.

Figure 5A:
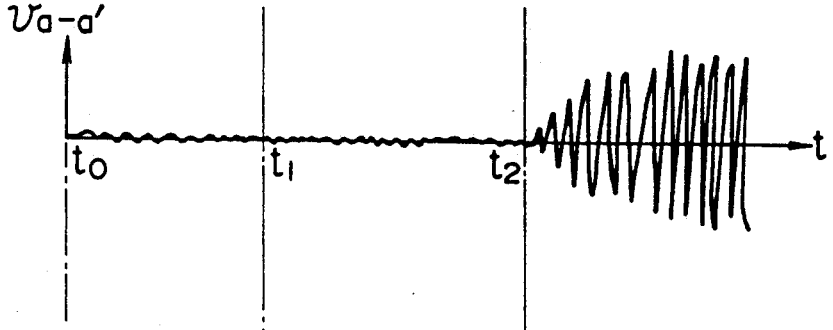
FIGS. 5A, 5B, 5C and 5D show waveforms observed at specific points (a—a', b—b', c—c') in the circuit of FIG. 4.
Figure 5B:
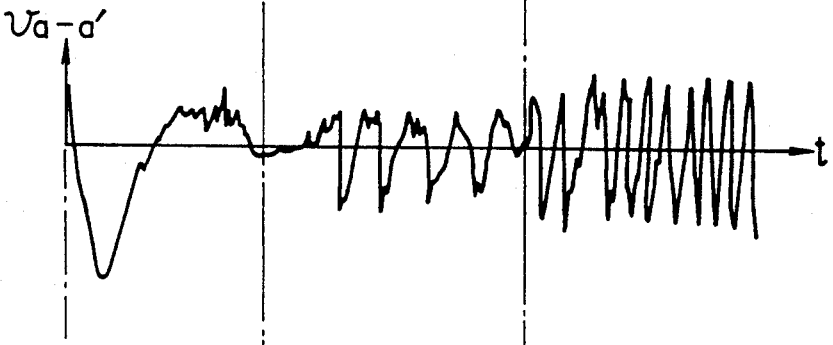

FIG. 5A shows a waveform observed between the section a—a' when the microwave oven is energized a sufficient length of time after a previous use, that is, from a cold state, and FIG. 5B a waveform observed when the microwave oven is energized immediately after heating by the second heat source, that is, from a hot state.

In FIG. 5A showing the case of energization in a cold state, the microwave oven is energized for heating at a point in time $t_0$, and a signal is generated after a point in time $t_2$ when a great volume of vapor emanates from the food, namely the object 2 to be heated. In FIG. 5B showing a case in which the second heat source including the upper heater 35 and the lower heater 34 has been used, a noise signal due to the residual vapor is generated and is mixed with the vapor signal required to be detected. The noise signal of FIG. 5B will be explained more in detail below.

Simultaneously with the start of the heating operation of the microwave oven at time $t_0$, the fan motor 15 is energized and the cold air generated thereby cools the pyroelectric element 5. As a result, the temperature of the pyroelectric element 5 is reduced to generate a positive voltage (on the electrode 38) immediately after the start of operation of the microwave oven. The wind from the cooling fan 16 then causes the hot air remaining in the heating chamber 1 to reach the pyroelectric element 5 through the air path and increases the temperature of the pyroelectric element 5. The voltage across the element swings greatly to the negative side, thus generating a maximum voltage. The voltage thus swung to the negative side is shifted to the positive side with the temperature of the pyroelectric element 5 reaching a ceiling and decreasing again. Zero voltage is subsequently reached once in equilibrium.

This process of change occurs during a short period of a few seconds to several tens of seconds immediately after the energization of the microwave oven and is finished substantially within the first 30 seconds (before time $t_1$). Even after termination of this transient voltage generated immediately after starting, however, the hot air remaining in the heating chamber 1 causes a noise voltage unlike under a cold state. This noise voltage coexists with the vapor signal requiring to be detected (FIG. 5B). The voltage from $t_2$ to $t_0$ is caused by such a residual vapor.

In a circuit configuration including the sensor signal processing means 12 and the pyroelectric element 5 shown in FIG. 4 according to the present invention, the signal is half-wave rectified by a rectification diode 41 before being read by the control section 4, and the polarity of the pyroelectric element 5 is selected in such a manner that the voltage (positive voltages in FIGS. 5A-5C) remains due to the negative temperature change of the pyroelectric element 5. As seen from FIG. 5B, therefore, the detecting operation is not affected by the negative voltage containing a maximum amplitude voltage generated by residual hot air The negative voltage is the most likely to cause erroneous detection, among the voltages generated during a period of scores of seconds immediately following the start of the cooling fan 16.

Further, the voltages generated by the pyroelectric element 5 due to vapor and due to hot air are different in the manner of response, though both are caused by heat. In response to vapor, a voltage of substantially the same positive or negative degree is generated either in the temperature rise time or in the temperature fall time, while, in response to hot air, a voltage comparatively lower is generated in the temperature fall time than in the temperature rise time. This is considered to be due to the fact that the temperature decrease is largely affected by the heat vaporization of waterdrops adhered when vapor is involved, while the voltage generation due to hot air is not accompanied by any similar physical change. In any event, the sensitivity characteristic of the pyroelectric element 5 is such that, in the process of vapor detection after the heater energization, the noise voltage generated by hot air has a small voltage amplitude as compared with that of the detection voltage due to vapor during a temperature decrease. The circuit configuration and the polarity of connection of the pyroelectric element 5 according to the present invention remarkably reduces a possibility of detecting a noise voltage erroneously as a vapor signal.

Figure 5C:
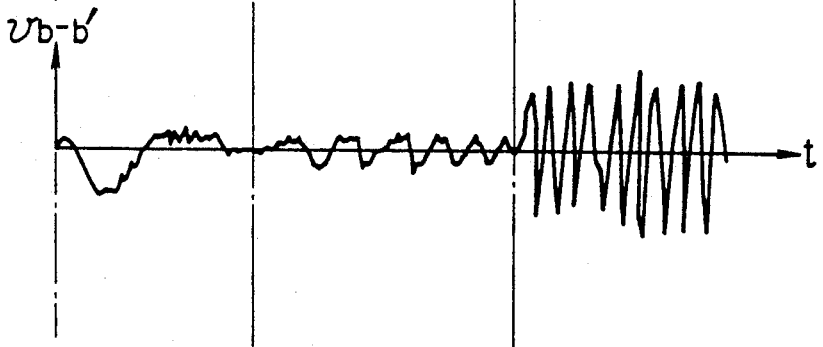
Figure 5D:
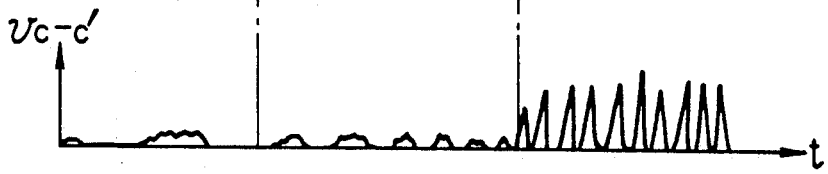

The sensor signal processing means shown in FIG. 4 according to the present invention, further includes a high-pass RC circuit 43 having a capacitor 42 and a resistor 46 with the time constant thereof determined approximately from T=0.5 to 1.0. The frequency components of the detection signal generated by the resistor K46 spread over a comparatively wide area up to a frequency range higher than 6 Hz, while the noise voltage due to hot air is mainly caused by the fluctuations of hot air induced by the revolution of the turntable 33 of one rotation for each ten seconds. The change in the noise voltage, therefore, is comparatively slow with the frequency components thereof distributed mainly in the range from $1/T_1$ Hz ($T_1$: Rotational period of the turntable 33) to two Hz. Even in the case where the noise is mixed under a hot state as mentioned above, the low-frequency control means including the high-pass RC circuit 43 attenuates the noise components due to the residual vapor mainly comprised of low frequencies to a degree more than the signal components due to vapor. Determination of a frequency range to be suppressed depends on the relationship between the frequency components of the signal voltage to be detected and those of the noise voltage to attenuated. The above-mentioned conditions, however, make it a best solution to set the upper limit of the frequency to be dampened substantially in a range from two to $1T_1$ Hz, or more specifically, in a range from one to two Hz. The result is an improved signal-to-noise ratio of the vapor signal and a greatly reduced probability of erroneous detection. The high-pass RC circuit 43, of course, functions also as a DC-blocking circuit for preventing the DC voltage from being applied to the pyroelectric element 5. The pyroelectric element 5 generally includes a silver electrode, and the application thereto of a DC voltage has to be prevented in order to avoid the deterioration of insulation caused by migration of silver. FIG. 5C shows a voltage waveform passed through the high-pass RC circuit in this way, and FIG. 5D the same voltage waveform further half-wave rectified by the rectification diode 41 and applied to the control section 4. The noise voltage generated by residual vapor in the heating chamber 1 is thus greatly dampened by the sensor signal processing means 12 before being applied to the control section 4.

The control section 4 has functions of applying an indication output signal to the operating section 13 in response to an input signal from the input keyboard of the operating means 13 and producing a signal for driving the drive means 11 to heat the object 2 by energization of the magnetron 3 or rotating the turntable 3. The control section also functions to make decisions for controlling various parts on the basis of a signal voltage transmitted from the pyroelectric element 5 through the sensor signal processing means 12.

Figure 6A:
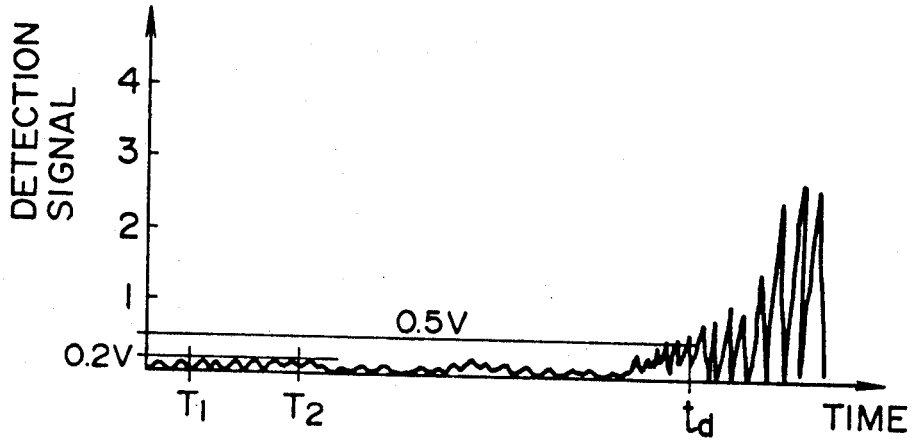
FIGS. 6A and 6B are diagrams showing the detection signal of the pyroelectric element produced by sensor signal processing means of the heating apparatus and changes with time thereof.
Figure 6B:
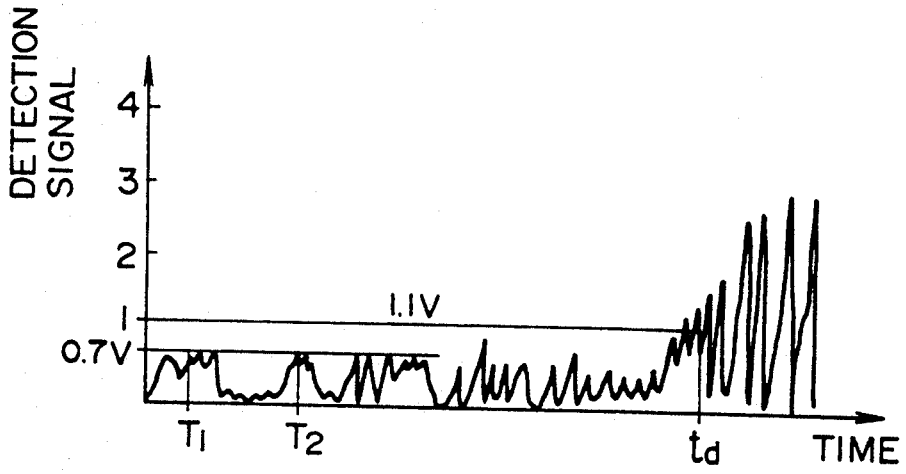
Figure 7:
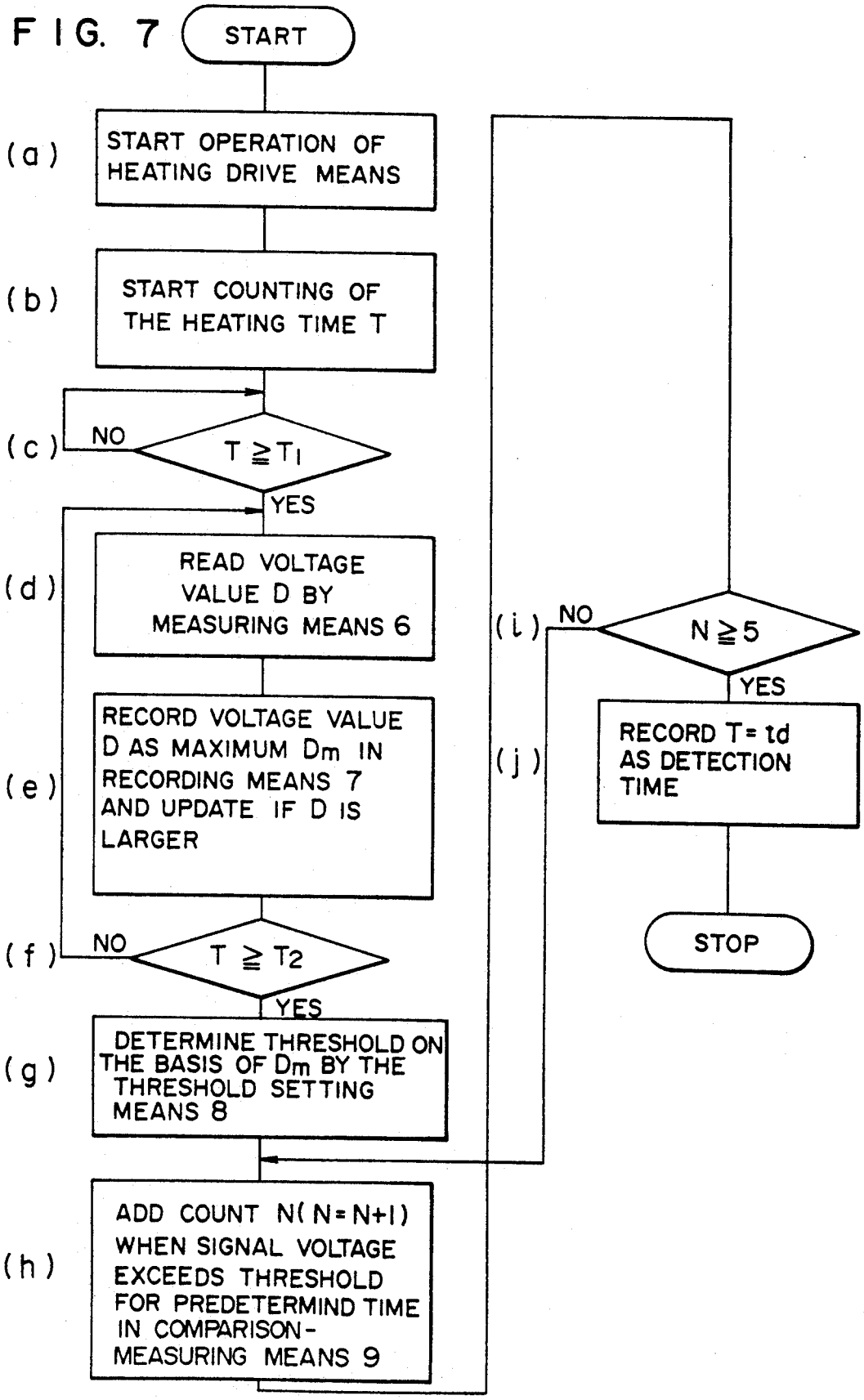
FIG. 7 is a flowchart showing a program structure for the heating control and the detection operation of an embodiment of the present invention.

Now, a method of detection and control by the control section 4 will be explained with reference to FIGS. 6A, 6B and 7.

First, the sequence and method of heating and automatic detection according to the present embodiment will be explained with reference to the flowchart of FIG. 7. Upon depression of a heating start key with an object 2 placed in the heating chamber 1, a control signal from the control section 4 is applied to the drive means 11 which then causes the operations of the magnetron 3 (high-voltage transformer 15), the fan motor 16 and the turntable 18 to be started (step a). The counting of the heating time T is started in the control section 4 (step b). The next step is to wait until the heating time T reaches a starting time point $T_1$ of a predetermined length of time (step c). The voltage value D of the signal voltage is read by measuring means 6 (step d). The voltage value D read is recorded by the recording means 7 and the recording means 7 determines the largest voltage value D as a maximum value $D_m$, and the voltage value D read subsequently is assumed as a new maximum value $D_m$ if larger than the recorded maximum value $D_m$ (step e). The steps d and e are repeated until the time point $T_2$ where the predetermined time elapses. A threshold value corresponding to the maximum value $D_m$ recorded in the recording means 7 is determined by threshold value-setting means 8 (step g). After time point $T_2$, comparison-measuring means 9 adds "1" to the count N ($N=N+1$), if the signal voltage exceeds the threshold value for a predetermined length of time (step h). This step h is repeated until the count N reaches a predetermined value (say, 5) (step i). When N reaches 5, $T=t_d$ is recorded as a detection time, and various parts including the magnetron are controlled accordingly (step j).

A method of decision and control has been explained above with reference to a flowchart. Now, the relationship between an output signal and a decision will be explained mainly with reference to FIGS. 6A and 6B.

The maximum value $D_m$ among the voltage values D is measured repeatedly during a predetermined period of time (from $T_1$ to $T_2$) after heating starts by the measuring means 6 in the control section 4 and then is recorded by the recording means 7. The threshold value selection means 8 of the control section 4 determines a threshold value providing a detection level for the value $D_m$ recorded by the recording means 7.

After time $T_2$, the comparison-measuring means 9 determines whether the detection signal has reached the threshold level, and if the threshold level is exceeded a predetermined number of times in succession, the count N of the counter in the comparison-measuring means 9 is incremented by one ($N=N+1$). When the count N of the counter reaches a predetermined number, say, five, the detection time $t_d$ is recorded as the point in time point when the object 2 has been heated optimally. In the process, the number of times the pulse signal exceeds the threshold value is counted in such a manner that when the threshold level is exceeded for a predetermined length of time or more, for example, 100 ms or more, one count is added.

Table 1 shown below is an example of a classification table used for selecting a threshold value.

TABLE 1

| $D_m$ | Threshold value |
|---|---|
| $0\text{ v} \leqq D_m < 0.3\text{ V}$ | 0.5 V |
| $0.3\text{ V} \leqq D_m < 2.5\text{ v}$ | $D_m + 0.4$ V |
| $2.5\text{ v} \leqq D_m$ | 3.0 V |

In Table 1, three constants including 0.5, 0.4 and 3.0 are prepared for setting a threshold level respectively for the three ranges of $D_m$, and a threshold value is determined according to this table.

The relationship between the signal level and detection time $t_d$ based on Table 1 will be explained with reference to FIGS. 6A and 6B. FIG. 6A shows an example of starting the heating operation from the cold state of the microwave oven (after being left to stand for at least a predetermined length of time from the preceding operation). FIG. 6B shows an example of starting a heating operation immediately after the heater operation when a great amount of residual hot air remains in the heating chamber 1. In the case of FIG. 6A, the signal level remains substantially zero during the period from the heating start to generation of vapor from the object 2, and the maximum value $D_m$ detected during a first predetermined period of time ($T_1$ to $T_2$) is 0.2 V. The threshold value is thus set to 0.5 V. As a result, the comparison-measuring means 9 comes to determine a finish detection time as $t_d$. In the case of FIG. 6B, on the other hand, the great amount of residual hot air in the heating chamber 1 causes a signal level of a considerable amplitude to be observed from the time immediately after starting the heating operation, and the maximum value $D_m$ is 0.7 V. The threshold value is thus set to a level of 1.1 V which is higher than the signal level ($D_m$) generated by the residual hot air, which level is of course higher than the level set for the cold start in FIG. 6A.

As explained above, the threshold level for determining the finish detection time $t_d$ is set in accordance with a signal voltage due to the residual hot air or the like detected before generation of vapor from the object 2. Erroneous detection (premature de-energization) is therefore prevented which otherwise might be caused by a signal voltage due to the residual hot air such as when the apparatus is started in a hot condition immediately after the heating with the heater.

In addition, in the case where the maximum value $D_m$ is larger than a predetermined value, or when $2.5 < D_m$ as shown in Table 1, the threshold level is fixed at 3.0 V regardless of the value $D_m$ for the purpose of preventing an excessive threshold level from leading to a detection failure (preventing the signal due to the vapor generated from the object from reaching a threshold level).

The pyroelectric element 5 composed of a ceramic element having a pyroelectricity according to the present embodiment may have piezoelectricity at the same time. A piezoelectric buzzer or an ultrasonic microphone using the characteristics of a piezoelectric element, for example, is of course applicable to the present invention with equal effect to the extent that they have pyroelectricity.

The advantages of the heating apparatus according to the present invention are as follows.

(1) The sensor signal processing means is so configured as to select a voltage of the polarity (half wave) generated during the temperature decrease of a pyroelectric element among the voltages generated by the pyroelectric element. Further, even when the apparatus is started with a great amount of hot air remaining in the heating chamber after the operation of the heater, the voltage of a large amplitude generated with a temperature rise of the pyroelectric element due to the residual hot air for several tens of seconds immediately after the start of operation can be removed. This prevents erroneous detection which otherwise might be caused by this type of residual hot air. Further, the pyroelectric element has such a sensitivity characteristic that the sensitivity thereof to the hot air fluctuations during temperature decrease is lower than that the sensitivity of the pyroelectric element to the vapor fluctuations. Erroneous detection due to the residual hot air occurs less often.

(2) The sensor signal processing means low-frequency wave dampening means for removing a slowly changing frequency component, and therefore it is adapted to remove the voltage component caused by heat exchange with the residual hot air induced by the operation of the turntable or the like having a lower rate of change than the fluctuation signal of the vapor generated from the object. The probability of occurrence of erroneous detection due to the residual hot air is thus remarkably reduced.

(3) In making a decision on the detection at the control section, a maximum value of the signal voltage is detected for a predetermined length of time (first predetermined time) after the heating operation has started. The number of times is counted by which a voltage pulse longer than a predetermined time width exceeds a threshold level set as a detection level for the maximum value according to a predetermined rule. The point in time when the count reaches a predetermined number (say, five) is regarded as a detection time point $t_d$. This method permits detection of an effective voltage signal level and obviates the problem of premature deenergization by erroneously detecting a noise signal of a high level due to the vapor remaining in the heating chamber immediately after operation of the heater.

In particular, while the first discrimination means detects a substantial maximum value and determines a corresponding threshold level, the comparison-measuring means counts signal pulses exceeding the threshold level for a predetermined length of time. By changing the method of deciding a signal voltage in this way, a noise signal and a vapor signal are separated from each other with higher accuracy.

We claim:

1. A heating apparatus comprising:

microwave heating means for heating an object thereby causing the object to emit a vapor;

pyroelectric means for detecting said vapor and outputting a signal having a first portion associated with discharge of heat from said pyroelectric element means and having a first polarity and a second portion having a second polarity; and means for eliminating the second portion of the signal, thereby isolating the first portion of the signal, the voltage of the first portion to be used to control said microwave heating means.

2. A heating apparatus comprising:

a heating chamber for accommodating an object to be heated;

microwave heating means for heating the object;

an air path for leading a portion of a gas in said heating chamber to outside of the heating chamber;

a pyroelectric element disposed in said air path;

sensor signal processing means, connected to said pyroelectric element, for receiving and processing an output voltage signal from said pyroelectric element, and for outputting a processed output voltage signal which is a first voltage signal with a first polarity; and a control section connected to said sensor signal which is processing means and said microwave heating means for controlling said microwave heating means by the processed output voltage signal of said sensor signal processing means, wherein at least one of said sensor signal processing means and said control section includes selection means, which comprise circuit means included in said control section for eliminating a voltage of polarity opposite to the first polarity, for selecting a portion of the processed output voltage signal having a first polarity associated with discharge of heat from said pyroelectric element due to heat exchange of said pyroelectric element, thereby controlling said microwave heating means based on a voltage level of the portion of the processed output voltage signal.

3. A heating apparatus according to claim 2, wherein said selection means comprises a diode and is included in said sensor signal processing means.

4. A heating apparatus according to claim 2, wherein said selection means comprises an amplifier circuit means in said sensor signal processing means for amplifying in only one polarity direction.

5. A heating apparatus comprising:

a heating chamber for containing an object to be heated;

a microwave heating means for heating the object thereby causing the object to emit a vapor in said heating chamber;

vapor directing means for directing the vapor in said heating chamber along a path outside of said heating chamber;

pyroelectric element disposed in said vapor directing means for detecting the vapor and outputting a signal having a first portion associated with discharge of heat from said pyroelectric element means and having a first polarity and a second portion having a second polarity; and means coupled to said pyroelectric element for eliminating the second portion of the signal thereby isolating and outputting the first portion of the signal to control said microwave heating means based on a voltage level of said first portion.

6. A heating apparatus comprising:

a heating chamber for accommodating an object to be heated;

microwave heating means for heating the object;

an air path for leading a part of a gas in the heating chamber to outside of the heating chamber;

a pyroelectric element disposed in the air path for outputting a first signal;

sensor signal processing means coupled to said pyroelectric element for receiving the first signal from said pyroelectric element and for outputting a processed output signal; and a control section, coupled to said sensor signal processing means, for controlling the heating means using the processed output signal from said sensor signal processing means, wherein said sensor signal processing means includes low-frequency eliminating means for eliminating low-frequency components of the first signal equal to or below 2 Hz.

7. A heating apparatus according to claim 6, wherein the low-frequency eliminating means comprises a high-pass RC circuit.

8. A heating apparatus comprising:

a heating chamber for accommodating an object to be heated;

microwave heating means for heating the object;

an air path for leading a path of a gas in the heating chamber to outside of the heating chamber;

a pyroelectric element disposed in the air path for outputting a first signal;

sensor signal processing means coupled to said pyroelectric element for receiving the first signal from said pyroelectric element and for outputting a processed output signal;

a control section, coupled to said sensor signal processing means, for controlling the heating means using the processed output signal from said sensor signal processing means;

turntable means disposed in said heating chamber for rotating the object to be heated with a period of rotation of $T_1$ seconds; and filtering means contained in said sensor signal processing means for eliminating components of the first signal in the range from 2 Hz to $1/T_1$ Hz.

9. A heating apparatus comprising:

a heating chamber for accommodating an object to be heated;

microwave heating means for heating the object;

an air path for leading a path of a gas in the heating chamber to outside of the heating chamber;

a pyroelectric element disposed in the air path;

sensor signal processing means coupled to said pyroelectric element for receiving a first signal from said pyroelectric element and for outputting a processed output signal; and a control section means coupled to said sensor signal processing means for controlling the microwave heating means using the processed output signal from said sensor signal processing means, wherein said control section means includes:

first memory means for storing a substantial maximum value of an output voltage of the processed output signal from said sensor signal processing means a first predetermined length of time after said microwave heating means begins to operate;

threshold setting means for calculating a threshold value based on the substantial maximum value stored in said first memory means and for storing the threshold value;

decision means for producing a result signal when the output signal from said sensor signal processing means has reached the threshold value after a lapse of a second predetermined length of time; and heat control means for controlling said microwave heating means in accordance with the result signal from said decision means.

10. A heating apparatus according to claim 9, wherein said threshold setting means calculates the threshold value to have a fixed value regardless of the magnitude of the maximum value.

11. A method of controlling a heating apparatus including a heating chamber for accommodating an object to be heated, microwave hating means for heating the object, a pyroelectric element for detecting a temperature of a gas in the heating chamber and outputting an output signal and sensor signal processing means for receiving the output signal from said pyroelectric element and outputting a processed output signal comprising the steps of:

a first step of detecting a substantial maximum value of an output voltage of the processed output signal for a first predetermined length of time and storing a first value representing a maximum value;

a second step of calculating a second value representing a threshold level based on the first value and storing the second value; and a third step of counting a number of times the voltage of the processed output signal continuously exceeds the second value for a time longer than a second predetermined length of time and for measuring an accumulated time during which the voltage of the processed output signal continuously exceeds the second value, and controlling said microwave heating means after the accumulated time has reached a predetermined value.

12. A method of controlling a heating apparatus according to claim 11, wherein said second step comprises setting the second value to a predetermined fixed value regardless of the magnitude of the first value.

* * * * *